US006409519B1

(12) United States Patent
Bacon

(10) Patent No.: US 6,409,519 B1
(45) Date of Patent: Jun. 25, 2002

(54) CIRCUIT BOARD CONNECTABLE RF RELAY

(75) Inventor: Louis Bacon, Laval (CA)

(73) Assignee: Electroline Equipment Inc., Montreal (CA)

( * ) Notice: Subject to any disclaimer, the term of this patent is extended or adjusted under 35 U.S.C. 154(b) by 0 days.

(21) Appl. No.: 10/020,878

(22) Filed: Dec. 19, 2001

(51) Int. Cl.[7] ..... H01R 9/09

(52) U.S. Cl. ..... 439/63; 439/578; 439/620; 439/581

(58) Field of Search ..... 439/63, 581, 578, 439/620

(56) References Cited

U.S. PATENT DOCUMENTS 6,152,743 A * 11/2000 Fox ..... 439/63

FOREIGN PATENT DOCUMENTS

GB 2 194 394 A * 3/1988 ..... 439/63

* cited by examiner

*Primary Examiner*—Tho D. Ta
(74) *Attorney, Agent, or Firm*—Norman B. Rainer

(57) ABSTRACT

A circuit board connectable RF relay that is comprised of a metal housing; a first RF signal input/output means; a second RF signal input/output means, wherein there is a cavity in the top portion of the metal housing called the upper cavity and a cavity in the bottom portion of the metal housing called the lower cavity, wherein there is an aperture in the top end of the upper cavity and the first RF signal input/output means is located in the upper cavity such that its first end is continuous with the aperture and its second end is continuous with the lower cavity, and wherein the second RF signal input/output means is located in the lower cavity such that its first end extends beyond the bottom of the metal housing and its second end is situated farther within the lower cavity such that it is not in direct conductive contact with the second end of the first RF signal input/output means, and an impedance loading contact, and an RF signal connection means having control signal inputs and a conductive moveable contact member, which RF signal connection means is situated in the lower cavity such that its conductive moveable contact member is able to close or open the circuit between the. first and second RF signal input/output means and to come into conductive contact with the impedance loading contact when the circuit is open, and a metal bottom housing cover, and a lower electrical insulating element having two apertures, which is centrally located within the metal bottom housing cover, and a means for securing the bottom end of the bottom portion of the metal housing to a printed circuit board, and a means for connecting the control signal inputs of the RF signal connection means to conducting paths of the printed circuit board.

10 Claims, 8 Drawing Sheets

CIRCUIT BOARD CONNECTABLE RF RELAY

TECHNICAL FIELD

The present invention relates to RF relays which can be directly connected to a printed circuit board, and in particular to remotely controllable RF relays which can be directly connected to a printed circuit board.

BACKGROUND ART

To the best of the Inventor's knowledge this is a unique invention which has no predecessors. For certain commercial applications, for example, in the cable network broadcast industry, multiple RF relays are required to coexist in relatively close proximity with each other and with other elements, all on the same printed circuit board. Many devices in which the printed circuit boards containing the multiple RF relays and other elements have to be placed, have size limitations, because those printed circuit boards are intended to become part of a pre-existing network which only has a certain amount of space within which they can be placed. When multiple RF relays are connected to a printed circuit board in close proximity with other RF relays or with other signal carrying elements or with the conducting paths of the printed circuit board to which the RF relays are not attached, then RF signal leakage can occur between the RF relays and each of the adjacent other RF relays, other signal carrying elements, and/or the conducting paths of the printed circuit board. Signal leakage between RF relays and other things can often be a problem.

For example, in the cable network broadcast industry, typical prior art RF relays that connect to printed circuit boards require the addition of RF shielding walls and grounding screws. Having to add shielding walls and grounding screws obviously increases production costs and production time, both of which are matters that all industries consider a problem.

A further problem is created by the designing of many prior art RF relays to lie horizontally on printed circuit boards. The horizontal orientation of RF relays on a printed circuit board takes up many times the physical space as would be required if the RF relays could be vertically attached to the printed circuit board. Obviously, it is not simply a matter of turning a horizontally designed RF relay on its end and then attaching it vertically to the printed circuit board, or the engineers would not be so foolish as to continue to attach them horizontally and thereby lose many times the space on the printed circuit board that they would have lost if they attached them vertically.

SUMMARY OF THE INVENTION

One object of the invention was to design a printed circuit board attachable RF relay that could be vertically attached to a printed circuit board.

A second object of the invention was to design a printed circuit board attachable RF relay that provided such a high degree of RF signal containment that shielding walls and grounding screws would only be minimally required or not be required at all.

A third object of the invention was to design a printed circuit board attachable RF relay would have a very good impedance matching.

A forth object of the invention was to design a printed circuit board attachable RF relay the cost of mass production of which would not be prohibitive.

A fifth object of the invention was to design a printed circuit board attachable RF relay that would meet all of the above four objects and still be relatively small.

The objects of the invention are accomplished by the invention of a circuit board connectable RF relay that is connectable to a printed circuit board, which printed circuit board has a ground and has multiple conducting paths, wherein the circuit board connectable RF relay is comprised of: a metal housing that is able to be grounded when the circuit board connectable RF relay is connected to a printed circuit board; a first RF signal input/output means, which has a first end and a second end; a second RF signal input/output means, which has a first end and a second end; and wherein there is a cavity in the top portion of the metal housing, which cavity is called the upper cavity, and wherein there is a cavity in the bottom portion of the metal housing, which cavity is called the lower cavity; and wherein there is an aperture in the top end of the upper cavity; and wherein the first RF signal input/output means is located in the upper cavity such that its first end is continuous with the aperture in the top end of the upper cavity, and its second end is continuous with the lower cavity; and wherein the second RF signal input/output means is located in the lower cavity such that its first end extends beyond the bottom of the bottom portion of the metal housing, and its second end is situated farther within the lower cavity, and its second end is not in direct conductive contact with the second end of the first RF signal input/output means; and an impedance loading contact; and an RF signal connection means that has a first control signal input, called the first control signal input, and that has a second control signal input, called the second control signal input, and that has a conductive moveable contact member, which RF signal connection means is situated in the lower cavity such that its conductive moveable contact member is able to be placed simultaneously in conductive contact with the second end of the first RF signal input/output means and the second end of the second RF signal input/output means, and such that the conductive moveable contact member of the RF signal connection means is able to be placed such that it does not provide a conductive path between the second end of the first RF signal input/output means and the second end of the second RF signal input/output means and that it does provide a conductive path with the impedance loading contact; and an upper electrical insulating element in the upper cavity which prevents the first RF signal input/output means from coming into conductive contact with the metal housing; and a metal bottom housing cover through which a portion of the first control signal input and through which a portion of the second control signal input can each non-conductivly pass; and a lower electrical insulating element which is centrally located within the metal bottom housing cover, which lower electrical insulating element electrically insulates the second RF signal input/output means and the impedance loading contact from the metal bottom housing cover; and a means for securing the bottom end of the bottom portion of the metal housing to a printed circuit board; and a means for connecting the first control signal input to a conducting path of the printed circuit board, when the bottom end of the bottom portion of the metal housing has been secured to the printed circuit board; and a means for connecting the second control signal input to a conducting path of the printed circuit board, when the bottom end of the bottom portion of the housing has been secured to the printed circuit board.

The instant invention accomplishes its first object by the creation of a circuit board connectable RF relay that is designed to have its bottom end attached to a printed circuit board, and thereby be mounted vertically on a circuit board. The instant invention accomplishes its second object through its metal housing, its inner insulating elements, and its conductive moveable contact member that becomes grounded when the circuit is open. In combination those components provide sufficient signal containment that shielding walls and grounding screws would only be minimally required or not required at all. The instant invention accomplishes its third object by the creation of a circuit board connectable RF relay that minimizes the path discontinuity between the first RF signal input/output means and the second RF signal input/output means. The fourth object of the invention is accomplished, because when the instant invention is mass produced its cost of production will not be prohibitive. The fifth object of the invention is accomplished, because the design of the instant invention meets all of the first four objects while allowing the printed circuit board attachable RF relay to remain relatively small.

DETAILED DESCRIPTION OF THE PREFERRED EMBODIMENTS

Figure 1:
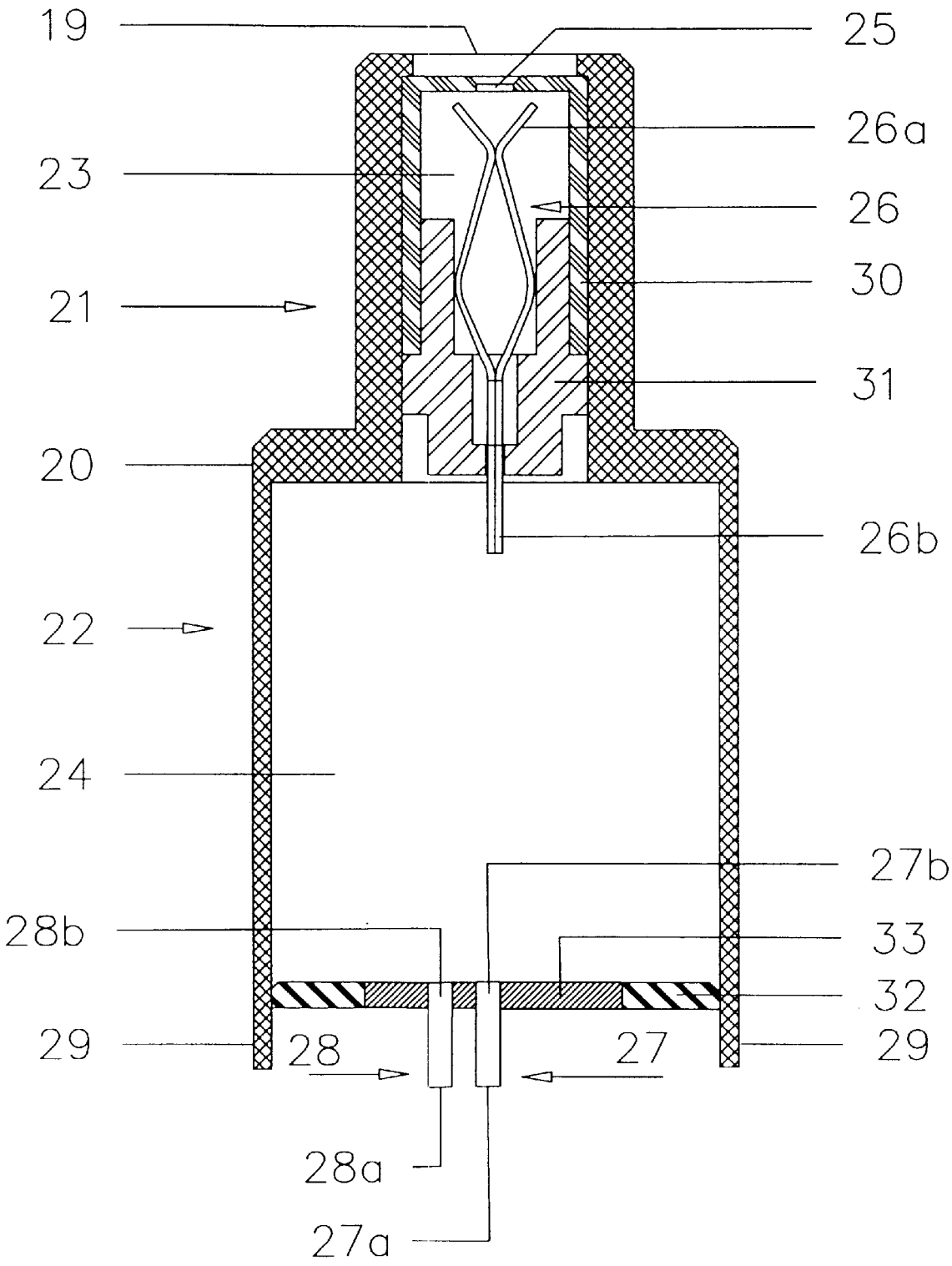
FIG. 1 shows a north-south axis vertical section of a circuit board connectable RF relay of the present invention.
Figure 2:
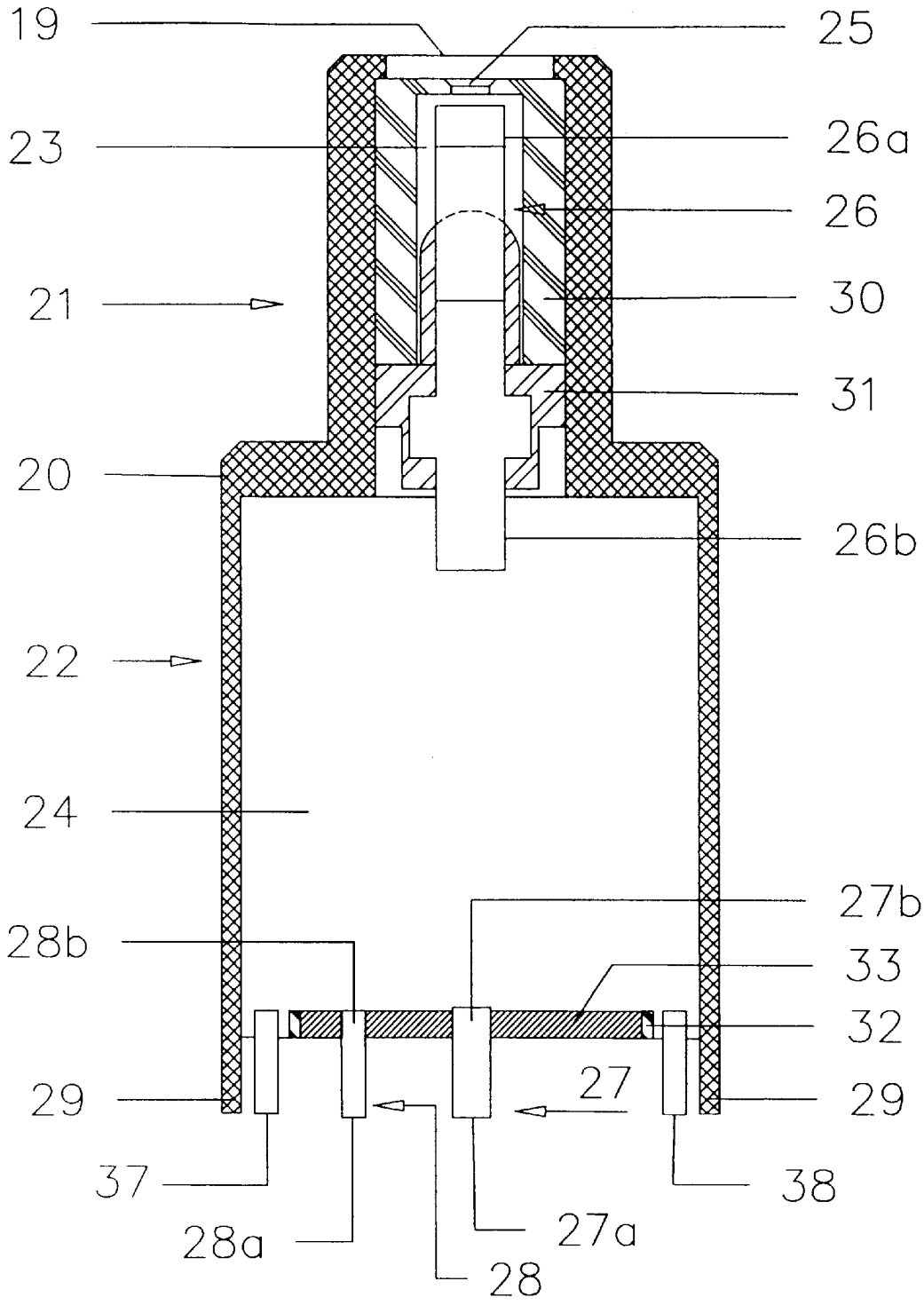
FIG. 2 shows an east-west axis vertical section of the circuit board connectable RF relay of the present invention that was shown in FIG. 1.

FIGS. 1 and 2 illustrate a preferred embodiment of a circuit board connectable RF relay of the present invention. The outside of the circuit board connectable RF relay illustrated in FIGS. 1 and 2 is a metal housing 20, that has a top portion 21 with a central aperture 25. Within the top portion 21 of the metal housing 20 is an upper cavity 23. Within the bottom portion 22 of the metal housing 20 is a lower cavity 24. A first RF signal input/output means 26, which has a first end 26*a* and second end 26*b*, is situated in the upper cavity 23, such that its first end 26*a* is in communication with the aperture 25 of the metal housing 20, and such that its second end 26*b* depends into the lower cavity 24. A first upper electrical insulating element 30 lines most of the inner walls of the upper cavity. A second upper electrical insulating element 31 is situated in the lower half of the upper cavity as shown in FIGS. 1 and 2. In conjunction the first and second upper electrical insulating elements 30 and 31 hold the first RF signal input/output means 26 in place and prevent it from coming into conductive contact with the metal housing 20. Even though the preferred embodiments shown in the drawings use two upper electrical insulating elements, a single upper electrical insulating element could be used. A second RF signal input/output means 27, which has a first end 27*a* and a second end 27*b* is centrally situated in the bottom of the lower cavity 24 such that its second end 27*b* is situated within the lower cavity 24, but does not make direct conductive contact with the second end 26*b* of the first RF signal input/output means, and such that its first end 27*a* depends below the lower cavity. An impedance loading contact 28, which has a first end 28*a* and a second end 28*b* is situated in the bottom of the lower cavity 24 adjacent to the second RF input/output means 27. The first end 28*a* of the impedance loading contact 28 is connected to an external impedance source, which is not shown in the figures. An RF signal connection means, which is not shown in FIGS. 1 and 2, is located within the lower cavity 24. A bottom metal cover 32 (which becomes grounded when the invention is in use) closes off the bottom of the lower cavity 24. The RF signal connection means has a first control signal input and a second control signal input and a conductive moveable contact member. The conductive moveable contact member has a first contact end and a second contact end. The RF signal connection means is situated in the lower cavity 24, such that its first contact end is proximate the second end 26*b* of the first RF input/output means and its second contact end is proximate the second end 27*b* of the second RF input/output means. The RF signal connection means is able to move its moveable conductive contact member into simultaneous conductive contact with the second end 26*b* of the first RF signal input/output means and with the second end 27*b* of the second RF signal input/output means. The RF signal connection means is also able to move its moveable conductive contact member such that simultaneously: (i) its first end is not in conductive contact with the second end 26*b* of the first RF signal input/output means and (ii) its second end is not in conductive contact with the second end 27*b* of the second RF signal input/output means and (iii) its second end is in conductive contact with the bottom metal cover 32 and (iv) the conductive moveable contact member extension 36*a* is in conductive contact with the second end 27*b* of the second RF input/output means and (v) the conductive moveable contact member extension 36*a* is in conductive contact with the second end 28*b* of the impedance loading contact 28. A lower electrical insulating element 33 is centrally located within the bottom metal cover 32. The lower electrical insulating element 33 contains a first aperture through which a portion of the second RF signal input/output means 27 tightly passes. The lower electrical insulating element 33 contains a second aperture through which a portion of the impedance loading contact 28 tightly passes. A means 29 for securing the bottom end of the bottom portion of the metal housing 20 to a printed circuit board can be seen depending down from the bottom of the metal housing 20; in the FIGS. 1 and 2 preferred embodiment means 29 are pins. Also not shown in FIGS. 1 and 2 are the means for connecting the first and second control signal inputs of the RF signal connection means to conducting paths of the printed circuit board.

Figure 3:
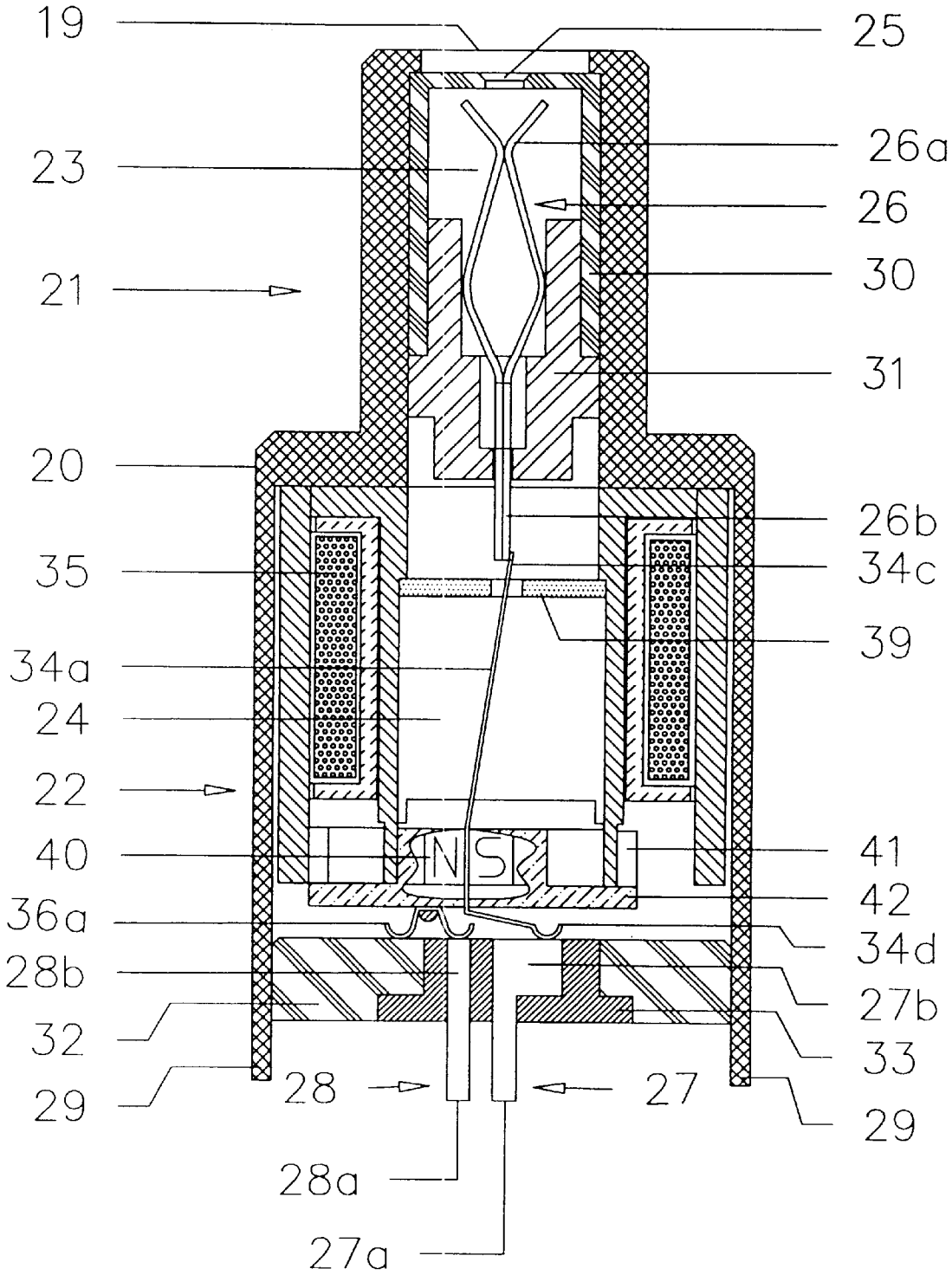
FIG. 3 shows a north-south axis vertical section of a circuit board connectable RF relay of the present invention that uses a lateral motion RF signal connection means.
Figure 4:
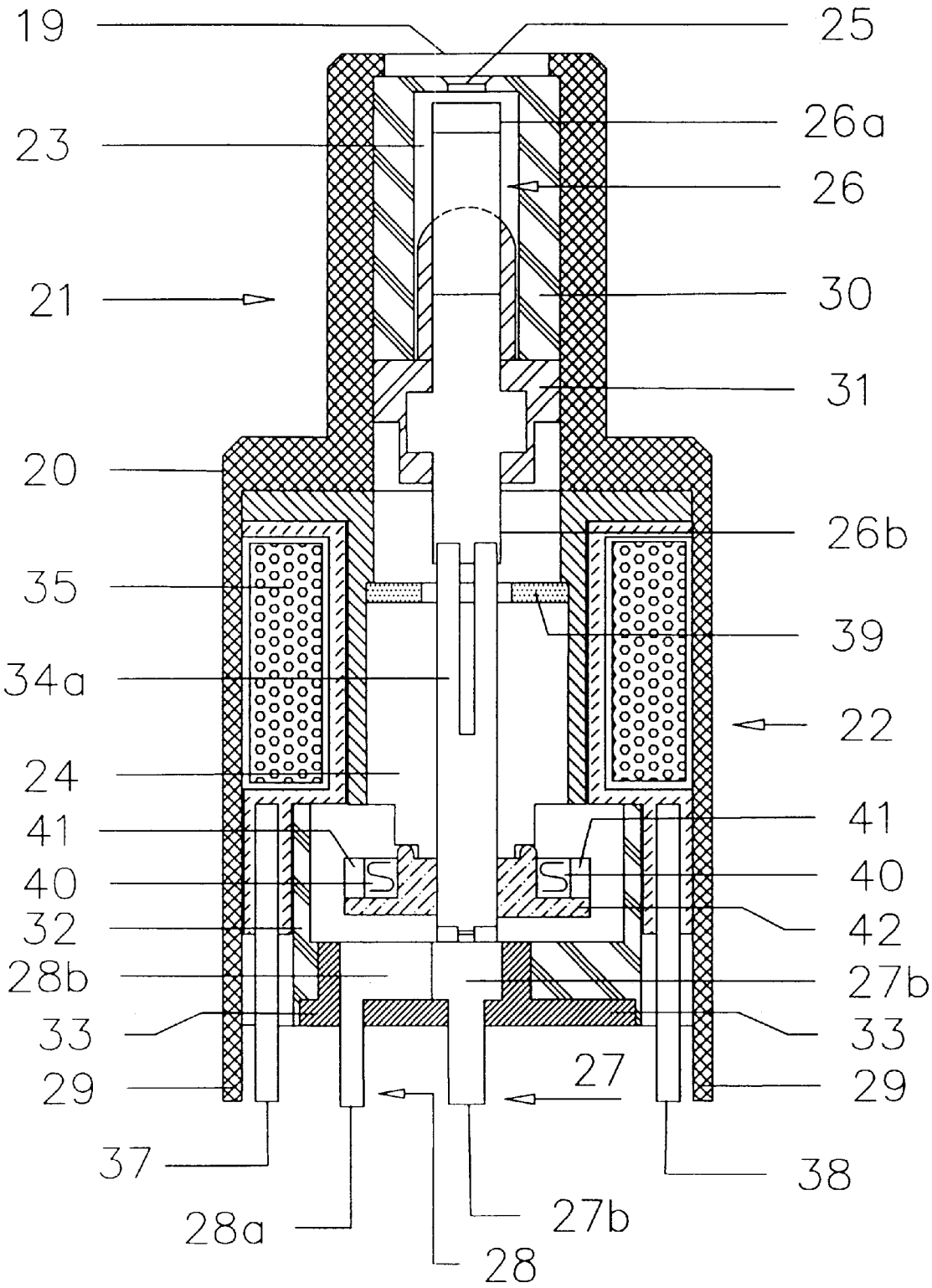
FIG. 4 shows an east-west axis vertical section of the circuit board connectable RF relay of the present invention that was shown in FIG. 3.
Figure 7:
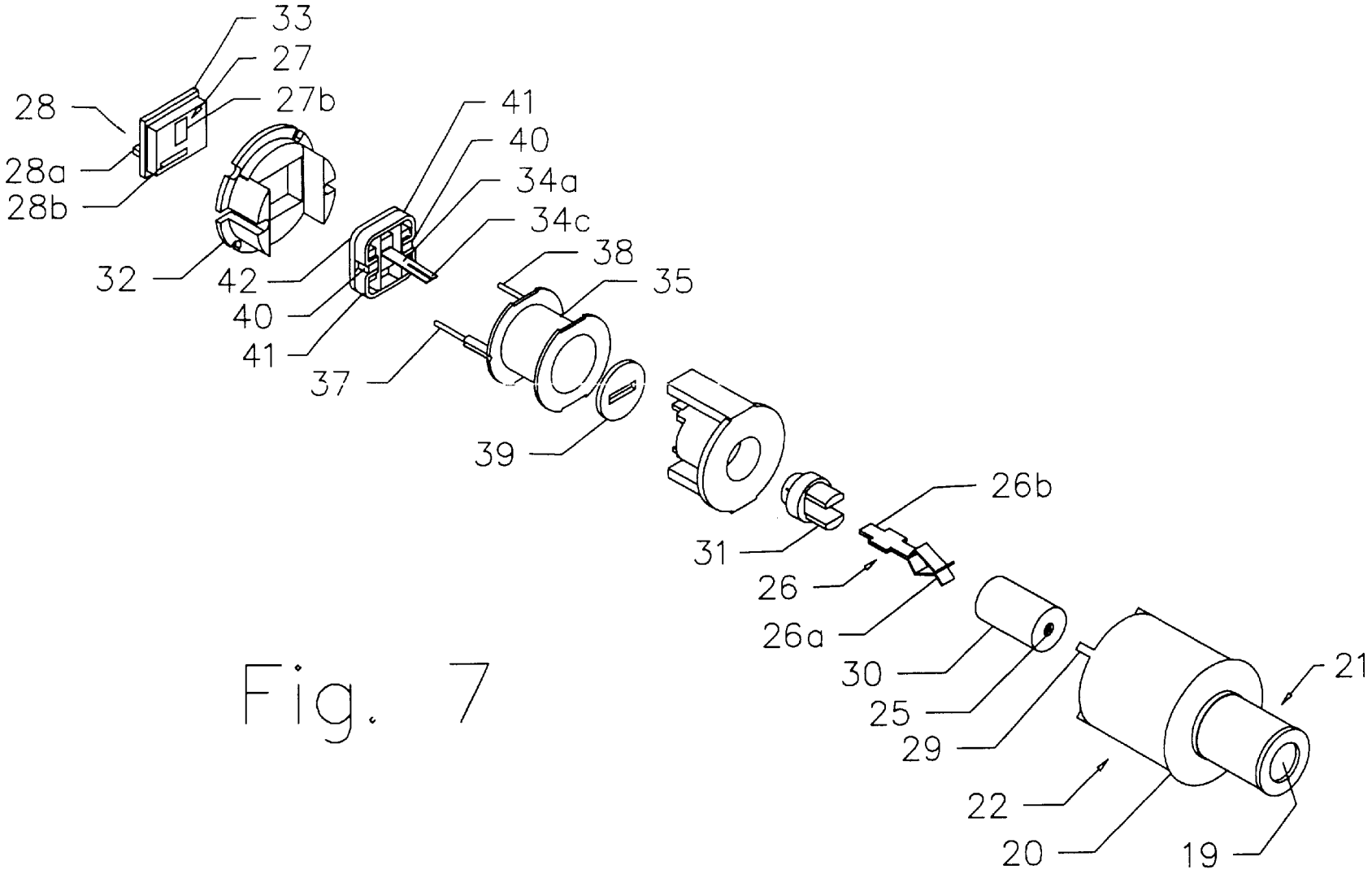
FIG. 7 shows an exploded perspective view of the circuit board connectable RF relay of the present invention that was shown in FIG. 3.

The preferred embodiment of the invention illustrated in FIGS. 3, 4 and 7, use a lateral movement RF signal connection means. The lateral movement RF signal connection means illustrated in FIGS. 3, 4 and 7 is made up of a first control signal input 37, a second control signal input 38, a conductive moveable contact member 34*a*, an electromagnetic coil 35, permanent magnets 40, a grounded RF shield 39, a conductive moveable contact member extension 36*a*, ferromagnetic half rings 41 which extend the magnet fields of the magnets 40, and the stand 42, which is made of an electrical insulating material. The conductive moveable contact member has a first contact end 34*c* and a second contact end 34*d*. The RF signal connection means is situated in the lower cavity 24, such that its first contact end 34*c* is proximate the second end 26*b* of the first RF input/output means and its second contact end 34*d* is proximate the second end 27*b* of the second RF input/output means.

It can be seen from FIGS. 3 and 4 that in construction the first control signal input 37 is partly situated within the lower cavity 24 and from there depends through the bottom metal cover 32 to the outside of the circuit board connectable RF relay. It can also be seen the second control signal input 38 is partly situated within the lower cavity 24 and from there depends through the bottom metal cover 32 to the outside of the circuit board connectable RF relay. From FIGS. 3 and 4 it can further be seen that in construction the electromagnetic coil 35 surrounds the grounded RF shield 39 and a portion of the conductive moveable contact member, which conductive moveable contact member is situated such that its first contact end 34*c* is proximate the second end 26*b* of the first RF input/output means and its second contact end 34*d* is proximate the second end 27*b* of the second RF input/output means. It can also be seen that the permanent magnets 40 and the ferromagnetic half rings 41 are situated beneath the electromagnetic coil 35, and that the conductive moveable contact member extension 36*a* is also situated beneath the permanent magnets 40.

In operation, the preferred embodiment illustrated in FIGS. 3, 4 and 7, operates as follows. On receiving an activation control signal via the appropriate one of the first control signal input 37 or the second control signal input 38, the electromagnetic coil 35 becomes an electromagnet polarized so as to cause the first contact end 34*c* to come into conductive contact with the second end 26*b* of the first RF input/output means and so as to cause the second contact end 34*d* to come into conductive contact with the second end 27*b* of the second RF input/output means. On receiving a deactivation control signal via the appropriate one of the first control signal input 37 or the second control signal input 38, the electromagnetic coil 35 becomes an electromagnet polarized so as to cause the first contact end 34*c* to go out of conductive contact with the second end 26*b* of the first RF input/output means and so as to cause the second contact end 34*d* to go out of conductive contact with the second end 27*b* of the second RF input/output means and into conductive contact with the metal cover 32, and so as to cause the first contact end 34*c* to go into conductive contact with the grounded RF shield 39, and so as to cause the conductive moveable contact member extension 36*a* to go into conductive contact with the second end 28*b* of the impedance loading contact 28 and so as to cause the conductive moveable contact member extension 36*a* to go into conductive contact with the second end 27*b* of the second RF input/output means. It can therefore be seen that in both the on and off state the second RF input/output means 27 has an impedance load, which factor together with the RF shielding provided by the metal body and insulating elements of the invention creates a very efficient and reliable circuit board connectable RF relay that has very a good containment of RF signal leakage. It can also be seen that the activation signal to close the RF relay does not have to remain on in order for the relay to continue to keep the circuit closed. The permanent magnets 40 will keep the conductive moveable contact member 34*a* in its closed position. Similarly it can be seen that the deactivation signal to open the RF relay does not have to remain on in order for to the relay to continue to keep the circuit open. The permanent magnets 40 will keep the conductive moveable contact member 34*a* in its open position Therefore no power is required to keep the RF relay in its open position or in its closed position.

Figure 5:
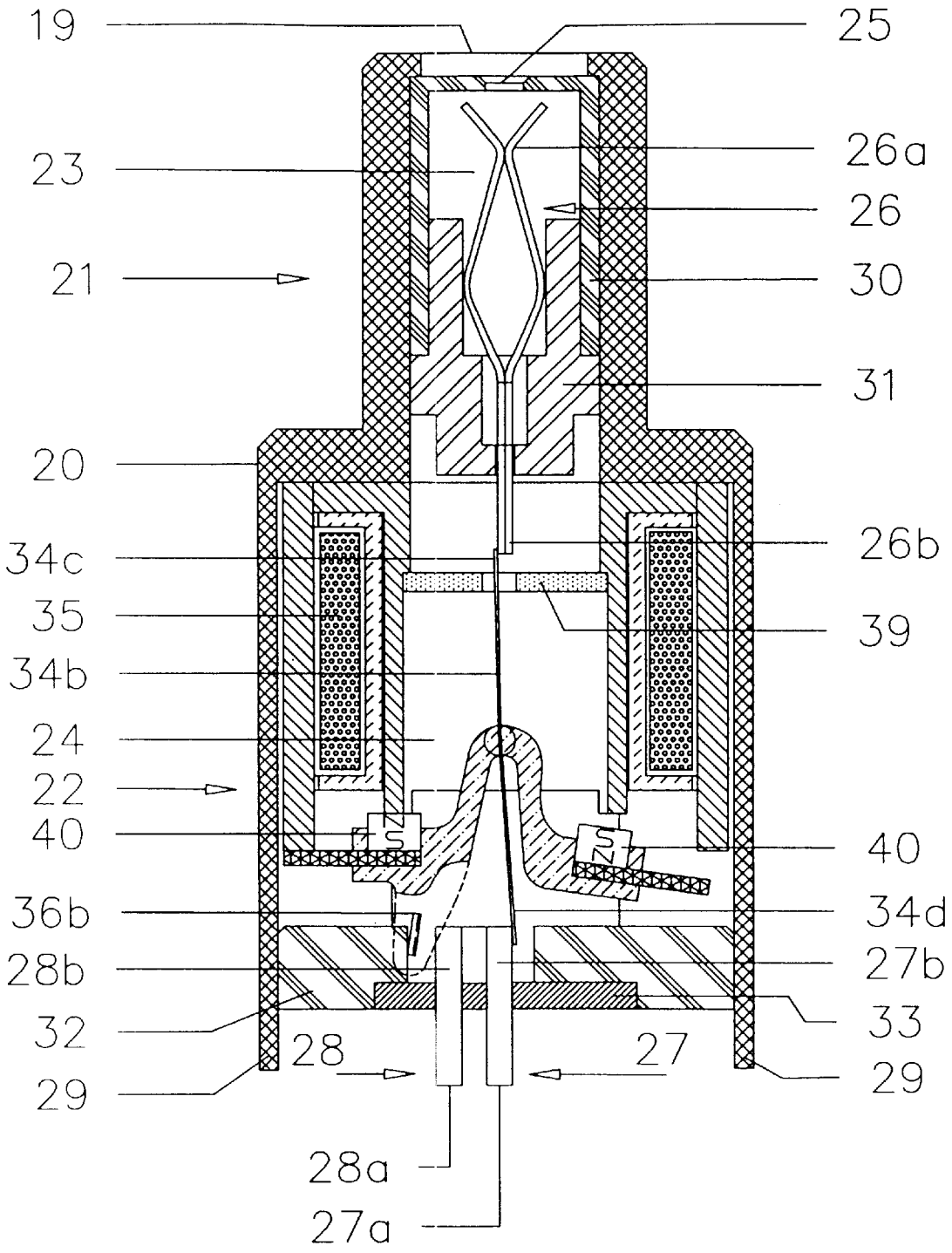
FIG. 5 shows a north-south axis vertical section of a circuit board connectable RF relay of the present invention that uses a toggle motion RF signal connection means.
Figure 6:
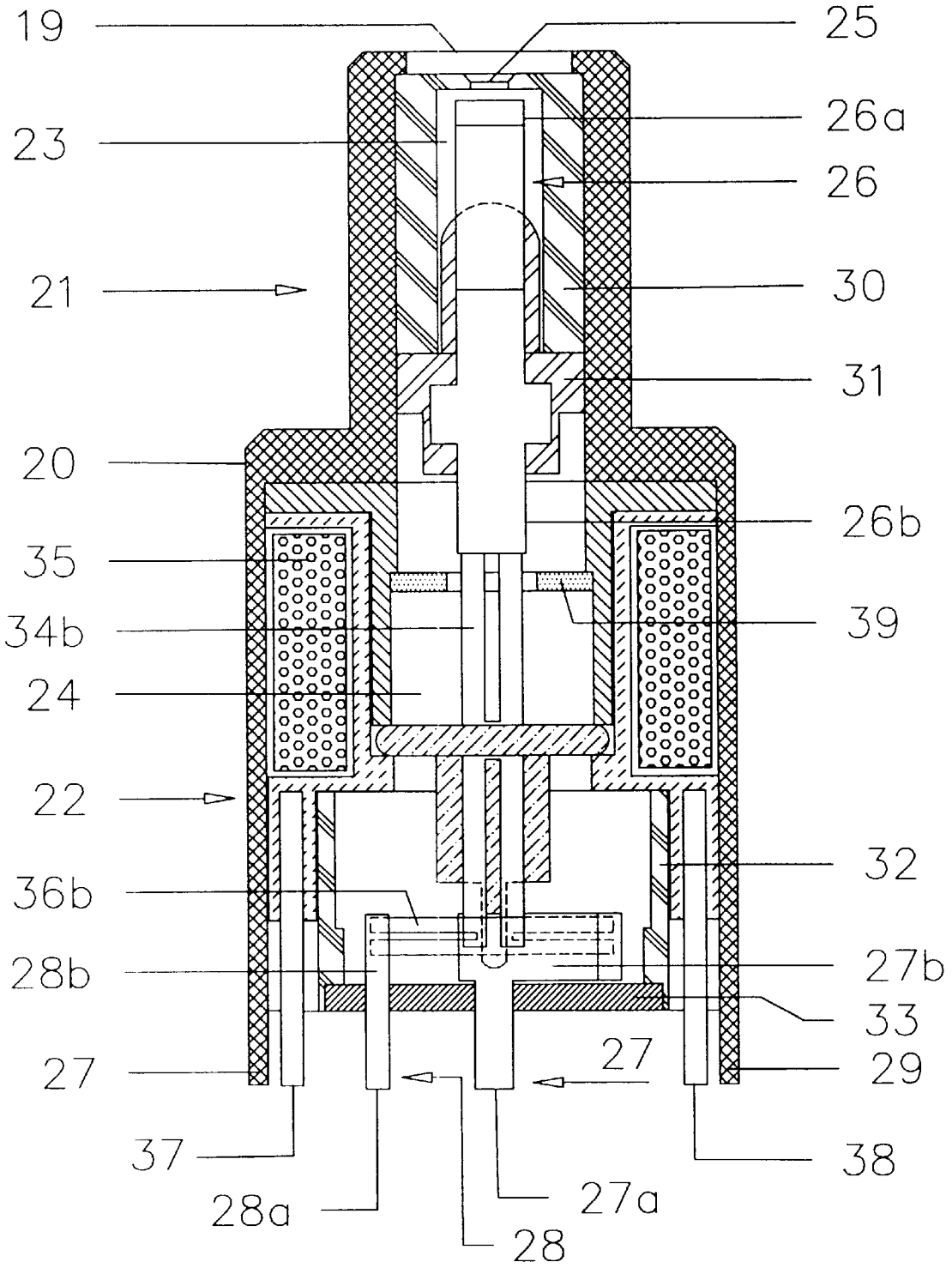
FIG. 6 shows an east-west axis vertical section of the circuit board connectable RF relay of the present invention that was shown in FIG. 5.
Figure 8:
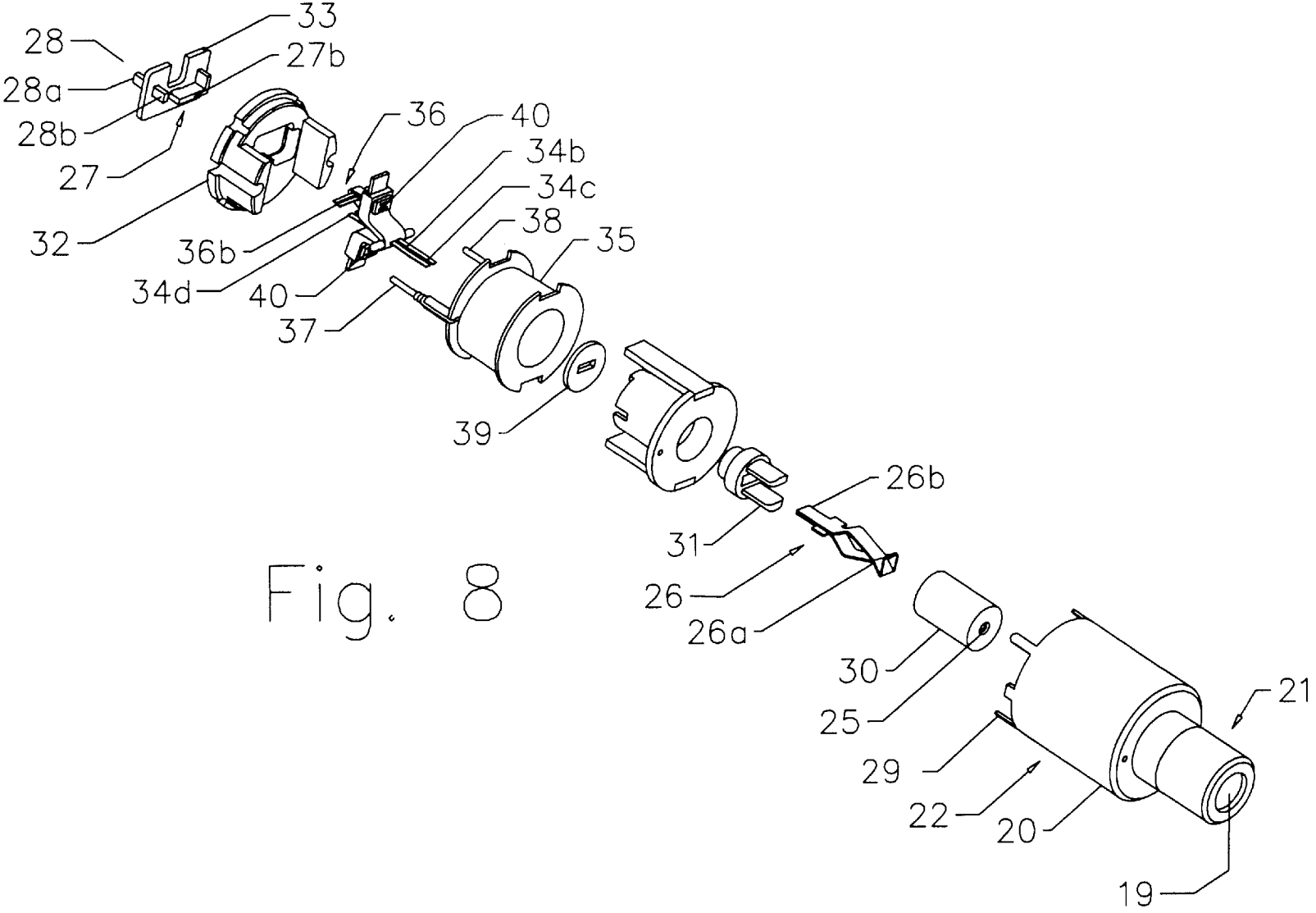
FIG. 8 shows an exploded perspective view of the circuit board connectable RF relay of the present invention that was shown in FIG. 5.

The preferred embodiment of the invention illustrated in FIGS. 5, 6 and 8, use a toggle movement RF signal connection means. The toggle movement RF signal connection means illustrated in FIGS. 5, 6 and 8 is made up of a first control signal input 37, a second control signal input 38, a conductive moveable contact member 34*b*, an electromagnetic coil 35, permanent magnets 40, a grounded RF shield 39, and a conductive moveable contact member extension 36*b*. The conductive moveable contact member has a first contact end 34*c* and a second contact end 34*d*. The RF signal connection means is situated in the lower cavity 24, such that its first contact end 34*c* is proximate the second end 26*b* of the first RF input/output means and its second contact end 34*d* is proximate the second end 27*b* of the second RF input/output means.

It can be seen from FIGS. 5 and 6 that in construction the first control signal input 37 is partly situated within the lower cavity 24 and from there depends through the bottom metal cover 32 to the outside of the circuit board connectable RF relay. It can also be seen the second control signal input 38 is partly situated within the lower cavity 24 and from there depends through the bottom metal cover 32 to the outside of the circuit board connectable RF relay. From FIGS. 5 and 6 it can further be seen that in construction the electromagnetic coil 35 surrounds the grounded RF shield 39 and a portion of the conductive moveable contact member, which conductive moveable contact member is situated such that its first contact end 34*c* is proximate the second end 26*b* of the first RF input/output means and its second contact end 34*d* is proximate the second end 27*b* of the second RF input/output means. It can also be seen that the permanent magnets 40 are situated beneath the electromagnetic coil 35, and that the conductive moveable contact member extension 36*b* is also situated beneath the permanent magnets 40.

In operation, the preferred embodiment illustrated in FIGS. 5, 6 and 8, operates as follows. On receiving an activation control signal via the appropriate one of the first control signal input 37 or the second control signal input 38, the electromagnetic coil 35 becomes an electromagnet polarized so as to cause the first contact end 34*c* to come into conductive contact with the second end 26*b* of the first RF input/output means and so as to cause the second contact end 34*d* to come into conductive contact with the second end 27*b* of the second RF input/output means. On receiving a deactivation control signal via the appropriate one of the first control signal input 37 or the second control signal input 38, the electromagnetic coil 35 becomes an electromagnet polarized so as to cause the first contact end 34*c* to go out of conductive contact with the second end 26*b* of the first RF input/output means and so as to cause the second contact end 34*d* to go out of conductive contact with the second end 27*b* of the second RF input/output means and into conductive contact with the metal cover 32, and so as to cause the first contact end 34*c* to go into conductive contact with the grounded RF shield 39, and so as to cause the conductive moveable contact member extension 36*b* to go into conductive contact with the second end 28*b* of the impedance loading contact 28, and so as to cause the conductive moveable contact member extension 36*b* to go into conductive contact with the second end 27*b* of the second RF input/output means. It can therefore be seen that in both the on and off state the conductive moveable contact member

34*b* has an impedance load, which factor together with the RF shielding provided by the metal body and insulating elements of the invention creates a very efficient and reliable circuit board connectable RF relay that has very a good containment of RF signal leakage. It can also be seen that the activation signal to close the RF relay does not have to remain on in order for the relay to continue to keep the circuit closed. The permanent magnets 40 will keep the conductive moveable contact member 34*a* in its closed position. Similarly it can be seen that the deactivation signal to open the RF relay does not have to remain on in order for the relay to continue to keep the circuit open. The permanent magnets 40 will keep the conductive moveable contact member 34*a* in its open position. Therefore no power is required to keep the RF relay in its open position or in its closed position.

It can also be seen that in some functional embodiments the conductive moveable contact member may be of such a shape that it performs the function of the conductive moveable contact member and of the conductive moveable contact member extension, in which case a separate conductive moveable contact member extension would not be required. It can further be seen that other forms of movement, for example rotary, are also possible in order to cause the conductive moveable contact member to close or open the circuit. Further, other types of variations are also possible and will be obvious to those skilled in the art. All of the variations to the invention that can be made and which should be obvious to those skilled in the art are covered by the appended claims, as they are within the scope of the invention.

I claim:

1. A circuit board connectable RF relay that is connectable to a printed circuit board, which printed circuit board has a ground and has multiple conducting paths, comprised of:

(a) a metal housing having a top portion and a bottom portion, wherein there is a cavity in the top portion called the upper cavity, and wherein there is a cavity in the bottom portion called the lower cavity, and wherein there is an aperture in the top end of the upper cavity, and wherein the metal housing is able to be grounded when the circuit board connectable RF relay is connected to a printed circuit board;

(b) a first RF signal input/output means, which has a first end and a second end;

(c) a second RF signal input/output means, which has a first end and a second end;

(d) wherein the first RF signal input/output means is located in the upper cavity of the metal housing such that its first end is continuous with the aperture in the top end of the upper cavity, and its second end is continuous with the lower cavity;

(e) wherein the second RF signal input/output means is located in the lower cavity of the metal housing such that its first end extends beyond the bottom of the bottom portion of the metal housing, and its second end is situated farther within the lower cavity, and its second end is not in direct conductive contact with the second end of the first RF signal input/output means;

(f) an impedance loading contact;

(g) an RF signal connection means that has a first control signal input and that has a second control signal input and that has a conductive moveable contact member;

(h) a metal bottom housing cover through which a portion of the first control signal input of the RF signal connection means can non-conductivly pass, and through which a portion of the second control signal input of the RF signal connection means can non-conductivly pass;

(i) wherein the RF signal connection means is situated in the lower cavity of the metal housing, such that its conductive moveable contact member is able to be placed simultaneously in conductive contact with the second end of the first RF signal input/output means and the second end of the second RF signal input/output means, and such that its conductive moveable contact member is able to be placed such that it does not provide a conductive path between the second end of the first RF signal input/output means and the second end; of the second RF signal input/output means and that its conductive moveable contact member does provide a conductive path with the impedance loading contact and with the metal bottom housing cover;

(j) a means for securing the bottom end of the bottom portion of the metal housing to a printed circuit board;

(k) a means for connecting the first control signal input of the RF signal connection means to a conducting path of the printed circuit board, when the bottom end of the bottom portion of the metal housing has been secured to the printed circuit board;

(l) a means for connecting the second control signal input of the RF signal connection means to a conducting path of the printed circuit board, when the bottom end of the bottom portion of the housing has been secured to the printed circuit board;

(m) an upper electrical insulating element that is located in the upper cavity of the top of the metal housing which prevents the first RF signal input/output means from coming into conductive contact with the metal housing; and (n) a lower electrical insulating element which is centrally located within the metal bottom housing cover, which lower electrical insulating element electrically insulates the second RF signal input/output means and the impedance loading contact from the metal bottom housing cover.

2. A circuit board connectable RF relay that is connectable to a printed circuit board, which printed circuit board has a ground and has multiple conducting paths as defined in claim 1, wherein the first RF signal input/output means is an RF coaxial connector.

3. A circuit board connectable RF relay that is connectable to a printed circuit board, which printed circuit board has a ground and has multiple conducting paths as defined in claim 1, wherein the first control signal input of the RF signal connection means is a pin that depends outwardly beyond the bottom of the bottom portion of the metal housing; and wherein the second control signal input of the RF signal connection means is a pin that depends outwardly beyond the bottom of the bottom portion of the metal housing.

4. A circuit board connectable RF relay that is connectable to a printed circuit board, which printed circuit board has a ground and has multiple conducting paths as defined in claim 1, wherein the means for securing the bottom end of the bottom portion of the metal housing to a printed circuit board are pins depending outwardly from the bottom end of the bottom portion of the metal housing.

5. A circuit board connectable RF relay that is connectable to a printed circuit board, which printed circuit board has a ground and has multiple conducting paths, as defined in claim 1 wherein the first RF signal input/output means is an RF coaxial connector; and wherein the first control signal input of the relay means is a pin that depends outwardly beyond the bottom of the bottom portion of the metal housing; and wherein the second control signal input of the relay means is a pin that depends outwardly beyond the bottom of the bottom portion of the metal housing.

6. A circuit board connectable RF relay that is connectable to a printed circuit board, which printed circuit board has a ground and has multiple conducting paths, as defined in claim 1 wherein the first RF signal input/output means is an RF coaxial connector; and wherein the first control signal input of the relay means is a pin that depends outwardly beyond the bottom of the bottom portion of the metal housing; and wherein the second control signal input of the relay means is a pin that depends outwardly beyond the bottom of the bottom portion of the metal housing; and wherein the means for securing the bottom end of the bottom portion of the metal housing to a printed circuit board are pins depending outwardly from the bottom end of the bottom portion of the metal housing.

7. A circuit board connectable RF relay that is connectable to a printed circuit board, which printed circuit board has a ground and has multiple conducting paths, comprised of:

(a) a metal housing having a top portion and a bottom portion, wherein there is a cavity in the top portion called the upper cavity, and wherein there is a cavity in the bottom portion called the lower cavity, and wherein there is an aperture in the top end of the upper cavity, and wherein the metal housing is able to be grounded when the circuit board connectable RF relay is connected to a printed circuit board;

(b) a first RF signal input/output means, which has a first end and a second end;

(c) a second RF signal input/output means, which has a first end and a second end;

(d) wherein the first RF signal input/output means is located in the upper cavity of the metal housing such that its first end is continuous with the aperture in the top end of the upper cavity, and its second end is continuous with the lower cavity;

(e) wherein the second RF signal input/output means is located in the lower cavity of the metal housing such that its first end extends beyond the bottom of the bottom portion of the metal housing, and its second end is situated farther within the lower cavity, and its second end is not in direct conductive contact with the second end of the first RF signal input/output means;

(f) an impedance loading contact;

(g) an RF signal connection means that has a first control signal input, and a second control signal input, and a conductive moveable contact member that has a first contact end and a second contact end, and an electromagnetic coil that surrounds a portion of the conductive moveable contact member, and permanent magnets that are situated beneath the electromagnetic coil, and a grounded RF shield that is surrounded by the electromagnetic coil, and a conductive moveable contact member extension that is situated beneath the permanent magnets, and a stand which is made of an electrical insulating material;

(h) a metal bottom housing cover through which a portion of the first control signal input of the RF signal connection means can non-conductivly pass, and through which a portion of the second control signal input of the RF signal connection means can non-conductivly pass;

(i) wherein the RF signal connection means is situated in the lower cavity of the metal housing, such that its conductive moveable contact member is able to be placed simultaneously in conductive contact with the second end of the first RF signal input/output means and the second end of the second RF signal input/output means, and such that its conductive moveable contact member is also able to be placed such that it does not provide a conductive path between the second end of the first RF signal input/output means and the second end of the second RF signal input/output means and that the second end of its conductive moveable contact member is in conductive contact with the metal bottom housing cover and that the conductive moveable contact member extension is in conductive contact with the second end of the second RF input/output means and that the conductive moveable contact member extension is in conductive contact with the impedance loading contact;

(j) a means for securing the bottom end of the bottom portion of the metal housing to a printed circuit board;

(k) a means for connecting the first control signal input of the RF signal connection means to a conducting path of the printed circuit board, when the bottom end of the bottom portion of the metal housing has been secured to the printed circuit board;

(l) a means for connecting the second control signal input of the RF signal connection means to a conducting path of the printed circuit board, when the bottom end of the bottom portion of the housing has been secured to the printed circuit board;

(m) an upper electrical insulating element that is located in the upper cavity of the top of the metal housing which prevents the first RF signal input/output means from coming into conductive contact with the metal housing; and (n) a lower electrical insulating element which is centrally located within the metal bottom housing cover, which lower electrical insulating element electrically insulates the second RF signal input/output means and the impedance loading contact from the metal bottom housing cover.

8. A circuit board connectable RF relay that is connectable to a printed circuit board, which printed circuit board has a ground and has multiple conducting paths, as defined in claim 7; wherein the first RF signal input/output means is an RF coaxial connector; and wherein the means for securing the bottom end of the bottom portion of the metal housing to a printed circuit board are pins depending outwardly from the bottom end of the bottom portion of the metal housing.

9. A circuit board connectable RF relay that is connectable to a printed circuit board, which printed circuit board has a ground and has multiple conducting paths, comprised of:

(a) a metal housing having a top portion and a bottom portion, wherein there is a cavity in the top portion called the upper cavity, and wherein there is a cavity in the bottom portion called the lower cavity, and wherein there is an aperture in the top end of the upper cavity, and wherein the metal housing is able to be grounded when the circuit board connectable RF relay is connected to a printed circuit board;

(b) a first RF signal input/output means, which has a first end and a second end;

(c) a second RF signal input/output means, which has a first end and a second end;

(d) wherein the first RF signal input/output means is located in the upper cavity of the metal housing such that its first end is continuous with the aperture in the top end of the upper cavity, and its second end is continuous with the lower cavity;

(e) wherein the second RF signal input/output means is located in the lower cavity of the metal housing such that its first end extends beyond the bottom of the bottom portion of the metal housing, and its second end is situated farther within the lower cavity, and its second end is not in direct conductive contact with the second end of the first RF signal input/output means;

(f) an impedance loading contact;

(g) an RF signal connection means that has a first control signal input, and a second control signal input, and a conductive moveable contact member that has a first contact end and a second contact end, and an electromagnetic coil that surrounds a portion of the conductive moveable contact member, and permanent magnets that are situated beneath the electromagnetic coil, and ferromagnetic half rings that are situated beneath the electromagnetic coil, and a grounded RF shield that is surrounded by the electromagnetic coil, and a conductive moveable contact member extension that is situated beneath the permanent magnets, and a stand which is made of an electrical insulating material;

(h) a metal bottom housing cover through which a portion of the first control signal input of the RF signal connection means can non-conductivly pass, and through which a portion of the second control signal input of the RF signal connection means can non-conductivly pass;

(i) wherein the RF signal connection means is situated in the lower cavity of the metal housing, such that its conductive moveable contact member is able to be placed simultaneously in conductive contact with the second end of the first RF signal input/output means and the second end of the second RF signal input/output means, and such that its conductive moveable contact member is also able to be placed such that it does not provide a conductive path between the second end of the first RF signal input/output means and the second end of the second RF signal input/output means and that the second end of its conductive moveable contact member is in conductive contact with the metal bottom housing cover and that the conductive moveable contact member extension is in conductive contact with the second end of the second RF input/output means and that the conductive moveable contact member extension is in conductive contact with the impedance loading contact;

(j) a means for securing the bottom end of the bottom portion of the metal housing to a printed circuit board;

(k) a means for connecting the first control signal input of the RF signal connection means to a conducting path of the printed circuit board, when the bottom end of the bottom portion of the metal housing has been secured to the printed circuit board;

(l) a means for connecting the second control signal input of the RF signal connection means to a conducting path of the printed circuit board, when the bottom end of the bottom portion of the housing has been secured to the printed circuit board;

(m) an upper electrical insulating element that is located in the upper cavity of the top of the metal housing which prevents the first RF signal input/output means from coming into conductive contact with the metal housing; and (n) a lower electrical insulating element which is centrally located within the metal bottom housing cover, which lower electrical insulating element electrically insulates the second RF signal input/output means and the impedance loading contact from the metal bottom housing cover.

10. A circuit board connectable RF relay that is connectable to a printed circuit board, which printed circuit board has a ground and has multiple conducting paths, as defined in claim 9; wherein the first RF signal input/output means is an RF coaxial connector; and wherein the means for securing the bottom end of the bottom portion of the metal housing to a printed circuit board are pins depending outwardly from the bottom end of the bottom portion of the metal housing.

* * * * *